US007467904B1

(12) United States Patent
Wager

(10) Patent No.: US 7,467,904 B1
(45) Date of Patent: Dec. 23, 2008

(54) TREE-RING CHRONOLOGY PENS, PENCILS, KEY CHAINS, AND OTHER COMMONLY USED ARTICLES

(76) Inventor: David Joseph Wager, 6107 Skyview Dr., Missoula, MT (US) 59803

( * ) Notice: Subject to any disclaimer, the term of this patent is extended or adjusted under 35 U.S.C. 154(b) by 238 days.

(21) Appl. No.: 11/607,609

(22) Filed: Dec. 4, 2006

(51) Int. Cl.
*B43K 25/00* (2006.01)

(52) U.S. Cl. ..... 401/52; 401/195; D19/48

(58) Field of Classification Search ..... 401/52, 401/195; D19/42, 47–51
See application file for complete search history.

(56) References Cited

U.S. PATENT DOCUMENTS 4,373,393 A 2/1983 Heikkenen
4,585,364 A 4/1986 Liaw
4,928,416 A 5/1990 Penno
D387,088 S 12/1997 Tseng
D391,292 S 2/1998 Kuo
D530,747 S * 10/2006 Leibeck ..... D19/48
7,418,874 B2 * 9/2008 Leitinger et al. ..... 73/826

FOREIGN PATENT DOCUMENTS

DE 3600810 7/1987

* cited by examiner

*Primary Examiner*—David J Walczak

(57) ABSTRACT

A pen comprising wood originating from cutting a tree transversely so it displays a tree's cross section. As a result of the transverse cutting, the product displays a tree's annual growth rings along one axis of the object. Tree-ring analysis is carried out in order to accurately date and subsequently mark the date on one or more of the annual growth rings on the pen. In addition to its operation as a writing instrument, the pen is operated as memorabilia that serves as a "natural" annual chart for important dates of an individual, company, organization, or other entity; a physical object to communicate the natural history of a tree's existence and/or the natural history of its surrounding environment; an educational tool to assist in teaching concepts of dendrochronology and related disciplines (dendroclimatology, dendroarchaeology, dendroecology).

2 Claims, 1 Drawing Sheet

TREE-RING CHRONOLOGY PENS, PENCILS, KEY CHAINS, AND OTHER COMMONLY USED ARTICLES

CROSS-REFERENCE TO RELATED APPLICATIONS

None

FEDERALLY SPONSORED RESEARCH

Not Applicable

SEQUENCE LISTING OR PROGRAM

Not Applicable

BACKGROUND

1. Field of Invention

Figure 1:
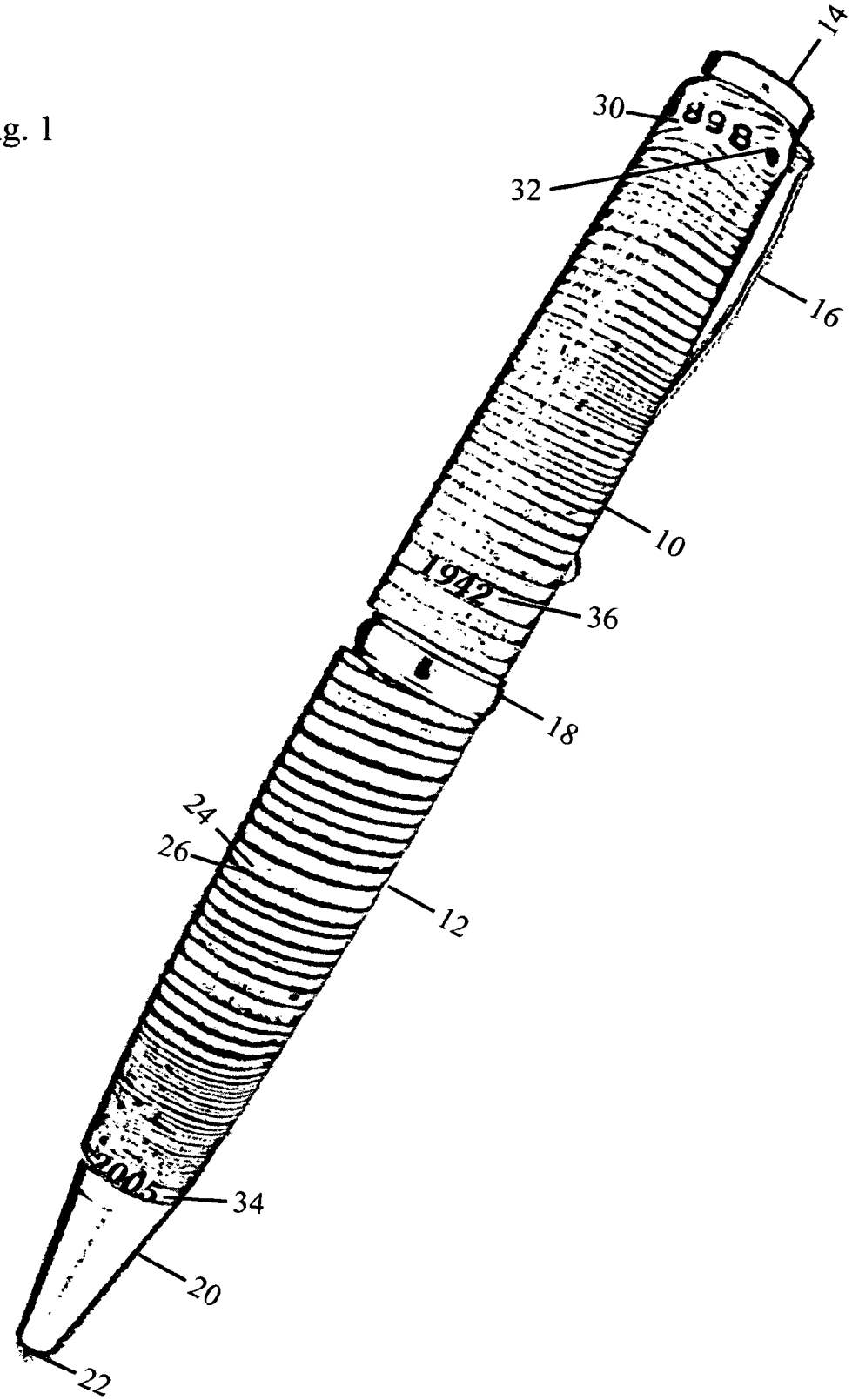

This invention relates to manufacturing wooden pens, pencils, key chains, and other commonly used articles in a manner that displays dated annual growth rings, and thus shows the tree's life history.

2. Prior Art

There are numerous examples of prior art of wooden pens, pencils, key chains, and other commonly used articles. However prior art of commonly used wooden articles fails to establish any relationship between the grain of the wood and the year the wood formed. In a given year a tree produces thin-walled cells formed early in the year and thicker-walled cells later in the year, referred to as earlywood and latewood, respectively. Each year a tree grows outward from the center. An abrupt boundary between latewood and earlywood marks the completion of one year of tree growth. Dendrochronology (also known as tree-ring analysis or tree-ring dating) is a technique for scientific dating based on the analysis of tree-ring growth patterns. This technique, originally developed by Andrew E. Douglas in the late $19^{th}$ century, involves counting and analyzing patterns of annual growth rings to date trees and learn about forest conditions and regional ecology. While working in the field of dendrochronology (e.g., Wager and Baker 2003-Canadian Journal of Forest Research) I encountered many members of the public who had little knowledge of tree-ring analysis techniques, but became very interested in it when it was explained to them. I observed that members of the general public, once exposed to the concept, found tree-ring analysis interesting, meaningful, and understandable.

There are numerous examples of prior art of wooden pens and pencils; however they offer no established relationship between the grain of the wood and the year the wood formed. Examples of this prior art include:

- U.S. Design Pat. Des. 391,292 that shows an ornamental design for a ballpoint pen.
- "Pens by Terry" http://www.pensbyterry.com/about.html is an example of the many wooden pen manufacturers that have established prior art of hand crafted wooden pens.

There are also examples of patents for combining pens, pencils, key chains with other inventions or concepts, e.g., FR 704 214 and in GB-2 004 096, for combining a watch and a pen into a single item by including a small watch onto the end of a pen, or at the end of a pen cap.

U.S. Pat. No. 4,928,416 established an accessory for attachment of promotional characters to pens and key chains to be used in advertising.

U.S. Pat. No. 4,373,393, issued to Heikkenen, describes a method of dendrochronology wherein the age of authenticity of timber structures is based on a correlation of the relative growth patterns of the woods used in the timber structure and the wood in samples taken from mature living trees on one or more sites in the general vicinity of timber structure's origin. There are numerous examples of cross sections of tree trunks in museums and in other places of public interest with biological explanations to illustrate the age or different growth phases of a tree.

German DE 36 00 810 A1 patented the process of attaching descriptive inscription labels on cross sections of tree trunks (similar to those observed in museums). The novelty of this invention is the use of inscription labels placed on a cross section piece of the trunk to associate events in the tree's life with historical events. Salient events (e.g., political, cultural, or scientific) of history are assigned to the annual rings of the wood cross section. The tree trunk cross section or a segment of it is then offered as a wall decoration or the like. Because DE 36 00 810 A1 does not cover manufacturing the cross section into a commonly used item (e.g., a pen or pencil), it is very similar to the existing prior art (tree trunks in museums) at the time of patent. The main differences are the use of inscription labels and that it is to be hung on a wall. Furthermore, cross sections of a tree trunk formed as a wall decoration do not have portability and multi-functioning qualities.

Prior art of pens, pencils, key chains, or other commonly used articles that display the tree ring chronology of the source wood could not be found.

SUMMARY

The invention is the process of cutting a tree transversely to supply wood for creation of a pen, pencil, key chain, and other commonly used articles; dating the transversely cut piece of wood using dendrochronology techniques; and marking the correct year of wood formation on one or more of the annual growth rings to show a tree-ring chronology through the article. These tree-ring chronology pens, pencils, key chains, and other commonly used articles present the concept of dendrochronology in a common and useful vehicle that can readily be shared with the general public.

DRAWINGS

Figures

FIG. 1 is a perspective view of the first embodiment of my tree-ring chronology pen.

DETAILED DESCRIPTION

FIG. 1 shows a perspective view of a tree-ring chronology pen, which is the preferred embodiment. Additionally, pencils, key chains, and other similar articles, which are not shown, can be produced with similar effect and purpose. The pen comprises wood originating from cutting a tree transversely, and then divided into two halves or barrels 10 and 12, representing a portion of a tree's cross section. As a result of the transverse cutting, the product displays a tree's annual growth rings along one axis of the object. In addition to the two barrels, the pen includes standard pen components including end cap 14, clip 16, center band 18, tip 20, ink cartridge (only tip shown) 22.

The two wooden barrels are characterized by distinct markings of annual growth rings. An annual growth ring is made up of lighter color thin-walled cells 24 formed early in the year followed by the dark thicker-walled cells produced later in the year 26, referred to as earlywood and latewood, respectively. The sharp boundary between the latewood of an annual ring and the early wood of the following annual ring, separates each annual growth ring. The date of wood formation 30, of the oldest (or near oldest) year (1898 in FIG. 1), is stamped on the pen. The center of the tree, called the pith, is shown at 32. The date of wood formation 34, of the most recent annual growth ring, is stamped on the pen. The date of wood formation 36, of a year of special significance, is marked on the pen.

Operation

The operation of the pen as a writing instrument is identical to that of pens in present use. However, in addition to its operation as a writing instrument, the pen is operated as:

1. Memorabilia that serves as a "natural" annual chart for important dates of an individual, company, organization, or other entity. In this form, the year(s) coinciding with a given event can be specially marked on the pen (FIG. 1). Examples of some uses include, but are not limited to, marking the dates of birthdays, wedding anniversaries, founding date of an organization, important milestones, and spans covering an employee's term of service.
2. A physical object to communicate the natural history of a tree's existence and/or the natural history of its surrounding environment. Some examples of this communication include, but are not limited to, demonstrating the effects of major climatic cyclic events (e.g., El Nino and La Nina years, major drought or wet years), overcrowded forest conditions due to fire suppression, tree damage from air pollution, root disturbance from earthquakes, and impacts of insect and disease outbreaks.
3. An educational tool to assist in teaching concepts of dendrochronology, and related disciplines (dendroclimatology, dendroarchaeology, dendroecology). Examples of concepts that the pen can facilitate in teaching include various tree-ring dating techniques and explaining the principle of limiting factors (e.g., water, sunlight) that control tree growth.

The inventor of the tree-ring chronology pens has alternative methods of embodying the invention, including:

Instead of a pen, the invention is embodied as a pencil, key chain, or other article Instead of using recently harvested trees, salvaged or recovered wood from previously sunken logs or old buildings is used. Dendrochronology techniques can be used to date this wood, even though the date of harvest is unknown.

Different species of trees, pen making materials, sizes, and interconnections, can be used for all components.

Instead of joining two halves of the chronology together, the article is manufactured from one solid piece.

Years can be stamped, written, or marked in many different ways on the articles including using symbols with a key.

The wood for manufacturing the pen, pencil, key chain, and other articles, is selected based on what story a given product line will communicate (e.g., selecting an 80 year old tree to show the association with an organization that has been in existence for 80 years; or selecting trees from a forest that suffered low growth during the drought years of the Dust Bowl (1934-1936) to show effects of drought and point out a historical event.)

ADVANTAGES

From the description above, a number of advantages of the tree-ring chronology pens, pencils, key chains, and other articles become evident. Tree-ring chronology pens represent a unique nexus, as elaborated below, of nature, art, science, and history all bound within a very common and utilitarian article.

1) Art—Wooden pens are revered, collected, and traded by a community of pen enthusiasts, who clearly see some pens as works of art
2) Nature—The natural history information imbedded in wood grain is rarely described in wooden articles. This invention displays natural history information of the tree and its environment. Furthermore, the preferred embodiment sources the pen wood from restoration thinning projects of western forests, which are unnaturally dense due to fire suppression. The restoration thinning projects protect old growth forests and restore the forest to conditions similar to pre-European settlement (see brochure in Appendix I). These forest restoration projects (which serve as the source for the wood) also protect homes and other structures from fire. Additionally, these forest restoration projects reduce CO2 emissions that would occur with catastrophic forest fires of un-thinned forests. One of the challenges of forest restoration thinning projects is finding value for the small diameter wood removed—this invention helps address that challenge.
3) Science—The science of dendrochronology involves dating of past events (e.g., fires, earthquakes, floods, climatic conditions) through study of tree-ring growth. Tree-ring chronology pens, pencils, and other articles use the science of dendrochronology on different tree species from a range of different forests. The pens serve as a convenient way to communicate the findings of this dendrochronology to a wide audience.
4) History—Celebration of anniversaries of important events, e.g., birthdays, wedding anniversaries, Independence Day, are prominent in our culture and society. Tree-ring chronology pens work as a natural calendar displaying the years leading up to and following historical events. Tree-ring chronology pens are a novel form of memorabilia for celebrating historical events and anniversaries.

CONCLUSIONS, RAMIFICATIONS, AND SCOPE OF INVENTION

Accordingly, through incorporating dendrochronology into these commonly used articles, several new dimensions are added to their meaning and use. These dimensions include communicating the historical events of a tree's life and/or its environment, a dendrochronology education tool, a novel form of memorabilia for celebrating historical events and anniversaries.

Thus, my invention, tree-ring chronology pens, pencils, key chains, and other articles presents the concept of dendrochronology in a common and useful vehicle that can readily be shared with the general public. Although the description of the above contains many specifics, these should not be construed as limiting the scope of the embodiment but as merely providing illustrations. For example, other embodiments include candlestick holders, coasters, letter openers, and tool handles. Thus the scope of the embodiment should be determined by the appended claims and their legal equivalents, rather than the examples given.

The invention claimed is:

1. A writing instrument, comprising:

(a) a writing element that leaves a marking line if moved across paper or other similar surfaces, and (b) a wood elongated holder surrounding and encasing said writing element, and with said wood made from cutting a tree transversely so the direction of the grain of said wood runs substantially perpendicular to a longitudinal axis of said elongated holder to thereby reveal said tree's annual rings which extend circumferentially around said elongated holder, and (c) a marking of the year of said tree's wood formation on one or more of the annual rings as means for displaying the tree-ring chronology through the writing instrument, and (d) whereby said writing instrument becomes memorabilia that serves as a natural annual chart for important dates of an individual, company, organization, or other entity, and whereby said writing instrument can communicate the natural history of said tree's existence and the natural history of its surrounding environment.

2. The writing instrument of claim 1 wherein said wood elongated holder is made from salvaged or recovered wood.

* * * * *